US008733406B2

(12) United States Patent
Hannes et al.

(10) Patent No.: US 8,733,406 B2
(45) Date of Patent: May 27, 2014

(54) METHOD AND APPARATUS FOR WEAVING PATTERN FORMATION IN WOVEN FABRICS WITH ADDITIONAL WEFT EFFECTS

(75) Inventors: Christian Hannes, Wangen (DE); Herbert Mueller, Pineville, NC (US)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 9 days.

(21) Appl. No.: 13/809,271

(22) PCT Filed: May 4, 2011

(86) PCT No.: PCT/EP2011/057131

§ 371 (c)(1),
(2), (4) Date: Jan. 9, 2013

(87) PCT Pub. No.: WO2012/004021

PCT Pub. Date: Jan. 12, 2012

(65) Prior Publication Data

US 2013/0105029 A1 May 2, 2013

(30) Foreign Application Priority Data

Jul. 9, 2010 (DE) ..... 10 2010 026 609

(51) Int. Cl.
*D03D 45/32* (2006.01)
*D03D 47/38* (2006.01)
*D03C 19/00* (2006.01)

(52) U.S. Cl.
CPC ..... *D03D 47/38* (2013.01); *D03C 19/00* (2013.01)
USPC ..... 139/1 R; 139/232 R

(58) Field of Classification Search
CPC ..... D03D 47/38; D03D 51/00; D03D 51/02; D03D 41/00; D03D 49/02; D03D 49/06; D03D 49/60; D03D 23/00; D03D 51/007; D03D 2700/19; D03D 47/27; D03D 47/3066; D03D 25/00; D03D 13/004; D03D 2700/85; D03D 47/263; D03D 47/267; D03D 47/277; D03J 1/00; D03C 13/00; D03C 3/20; D03C 1/14; D03C 3/24; D03C 1/16; D03C 19/00; D03C 19/005; D03C 17/06; D03C 11/00; D03C 15/00
USPC ..... 139/1 R, 232, 453, 317
See application file for complete search history.

(56) References Cited

U.S. PATENT DOCUMENTS 566,551 A * 8/1896 Veyron ..... 139/49
3,552,691 A * 1/1971 Haller ..... 245/10

(Continued)

FOREIGN PATENT DOCUMENTS

DE 102010007048 8/2011
EP 1 849 897 10/2007
WO WO 2007/093504 8/2007

OTHER PUBLICATIONS

International Search Report of the International Searching Authority for International Application PCT/EP2011/057131, mailed Jul. 30, 2012, 3 pages, European Patent Office, HV Rijswijk, Netherlands.

(Continued)

*Primary Examiner* — Bobby Muromoto, Jr.
(74) *Attorney, Agent, or Firm* — W. F. Fasse

(57) ABSTRACT

For weaving pattern formation of a woven fabric with weft threads (3), warp threads (1) and effect threads (2), data sets (20) are produced according to a method in which data values are derived from weft sequence numbers (30) and from positions of interlacing points (P) of an effect thread (2) with the weft threads (3) in the pattern repeat (29). These data sets (20) are supplemented by further data values (31, 32, 33, 34) derived from the weaving pattern, in such a manner so that they form a pattern draft (28) for a weaving pattern with additional weft effects. In a weaving machine with devices for slidingly displacing effect threads (2) in the weft direction (12), the weaving pattern formation is derived from the data sets (20) of this pattern draft (28).

18 Claims, 10 Drawing Sheets

(56) References Cited

U.S. PATENT DOCUMENTS

| | | | | | |
|---|---|---|---|---|---|
| 3,634,827 | A * | 1/1972 | Lourie et al. | 700/131 |
| 3,728,680 | A * | 4/1973 | Upshur | 340/679 |
| 3,744,035 | A * | 7/1973 | Geirhos et al. | 700/131 |
| 4,016,911 | A * | 4/1977 | Looker | 139/383 R |
| 4,406,312 | A * | 9/1983 | Egbers et al. | 139/453 |
| 4,429,722 | A * | 2/1984 | Herzog | 139/48 |
| 4,605,044 | A * | 8/1986 | Sakano | 139/304 |
| 4,716,943 | A * | 1/1988 | Yoshida et al. | 139/452 |
| 4,721,135 | A * | 1/1988 | Tsubata et al. | 139/46 |
| 5,056,566 | A * | 10/1991 | Salomez | 139/452 |
| 5,058,628 | A * | 10/1991 | Spiller et al. | 139/25 |
| 5,066,535 | A * | 11/1991 | Christie | 428/196 |
| 5,069,257 | A * | 12/1991 | Borisch | 139/99 |
| 5,390,709 | A * | 2/1995 | Martonffy | 139/456 |
| 5,412,578 | A * | 5/1995 | Takagi et al. | 700/192 |
| 5,568,826 | A * | 10/1996 | Vogel et al. | 139/25 |
| 5,582,213 | A * | 12/1996 | Okawa | 139/46 |
| 5,669,421 | A * | 9/1997 | Lehnert et al. | 139/1 R |
| 5,794,665 | A * | 8/1998 | Keim | 139/455 |
| 5,829,487 | A * | 11/1998 | Thomas et al. | 139/319 |
| 6,145,551 | A * | 11/2000 | Jayaraman et al. | 139/387 R |
| 6,220,309 | B1 * | 4/2001 | Sollars, Jr. | 139/389 |
| 6,257,283 | B1 * | 7/2001 | Lenzi | 139/50 |
| 6,467,512 | B1 * | 10/2002 | Meyer et al. | 139/435.2 |
| 6,595,244 | B1 * | 7/2003 | Sollars, Jr. | 139/389 |
| 6,650,779 | B2 * | 11/2003 | Vachtesvanos et al. | 382/228 |
| 6,659,139 | B2 * | 12/2003 | Laycock et al. | 139/422 |
| 6,876,162 | B2 * | 4/2005 | Bilcke | 318/34 |
| 6,904,942 | B2 * | 6/2005 | Odenthal | 139/383 A |
| 6,907,310 | B2 * | 6/2005 | Gardner et al. | 700/132 |
| 6,957,671 | B2 * | 10/2005 | Pannekoucke et al. | 139/50 |
| 6,978,808 | B2 * | 12/2005 | Walsh et al. | 139/11 |
| 6,994,120 | B2 * | 2/2006 | Speich | 139/1 R |
| 7,409,970 | B2 * | 8/2008 | Sollars, Jr. | 139/389 |
| 7,438,092 | B2 * | 10/2008 | Wahhoud | 139/50 |
| 7,513,276 | B2 * | 4/2009 | Westerkamp | 139/383 A |
| 8,136,555 | B1 * | 3/2012 | Chang et al. | 139/384 R |
| 2001/0039974 | A1 * | 11/2001 | Wahhoud et al. | 139/25 |
| 2003/0064646 | A1 * | 4/2003 | Brown et al. | 442/189 |
| 2003/0066569 | A1 * | 4/2003 | Wahhoud | 139/110 |
| 2003/0070721 | A1 * | 4/2003 | Wahhoud | 139/435.1 |
| 2003/0136459 | A1 * | 7/2003 | Laycock et al. | 139/421 |
| 2003/0178087 | A1 * | 9/2003 | Odenthal | 139/383 A |
| 2004/0065380 | A1 * | 4/2004 | Speich | 139/383 R |
| 2004/0094223 | A1 * | 5/2004 | Johnson et al. | 139/383 A |
| 2005/0011578 | A1 * | 1/2005 | Walsh et al. | 139/383 R |
| 2006/0249933 | A1 * | 11/2006 | Sollars | 280/729 |
| 2006/0281382 | A1 * | 12/2006 | Karayianni et al. | 442/181 |
| 2007/0028992 | A1 * | 2/2007 | Westerkamp | 139/383 A |
| 2008/0169040 | A1 * | 7/2008 | Barrett | 139/383 A |
| 2008/0228312 | A1 * | 9/2008 | Dickerson | 700/132 |
| 2009/0035537 | A1 * | 2/2009 | Hack-Ueberall et al. | 428/196 |
| 2009/0053288 | A1 * | 2/2009 | Eskridge et al. | 424/447 |
| 2009/0191777 | A1 * | 7/2009 | Liao | 442/184 |
| 2010/0032120 | A1 * | 2/2010 | Ringer et al. | 162/358.2 |
| 2010/0139540 | A1 * | 6/2010 | Cronburg et al. | 114/102.29 |
| 2011/0030909 | A1 * | 2/2011 | Danby et al. | 162/358.2 |
| 2011/0114278 | A1 * | 5/2011 | Stone et al. | 162/289 |
| 2011/0130860 | A1 * | 6/2011 | Kelley | 700/121 |
| 2012/0102615 | A1 * | 5/2012 | Dickerson | 2/69 |
| 2012/0178330 | A1 * | 7/2012 | Stone | 442/295 |
| 2012/0244772 | A1 * | 9/2012 | Elder | 442/203 |
| 2013/0340881 | A1 * | 12/2013 | Boegl et al. | 139/55.1 |

OTHER PUBLICATIONS

PCT International Preliminary Report on Patentability including English Translation of PCT Written Opinion of the International Searching Authority for International Application PCT/EP2011/057131, mailed Jan. 24, 2013, 9 pages, International Bureau of WIPO, Geneva, Switzerland.

Graebner, Ernst, Fachbuchverlag GmbH, Leipzig, Germany, "Die Weberei" (The Weaving), 13$^{th}$ edition, 1953, pp. 232 to 233.

* cited by examiner

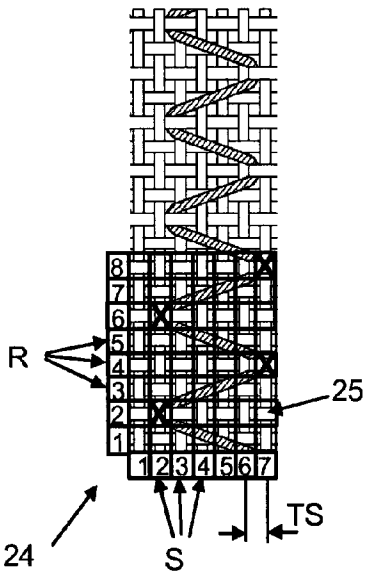
Fig. 2.2
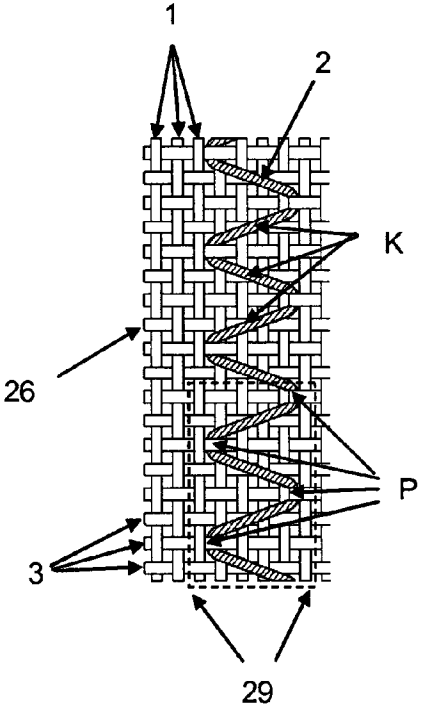
Fig. 2.1

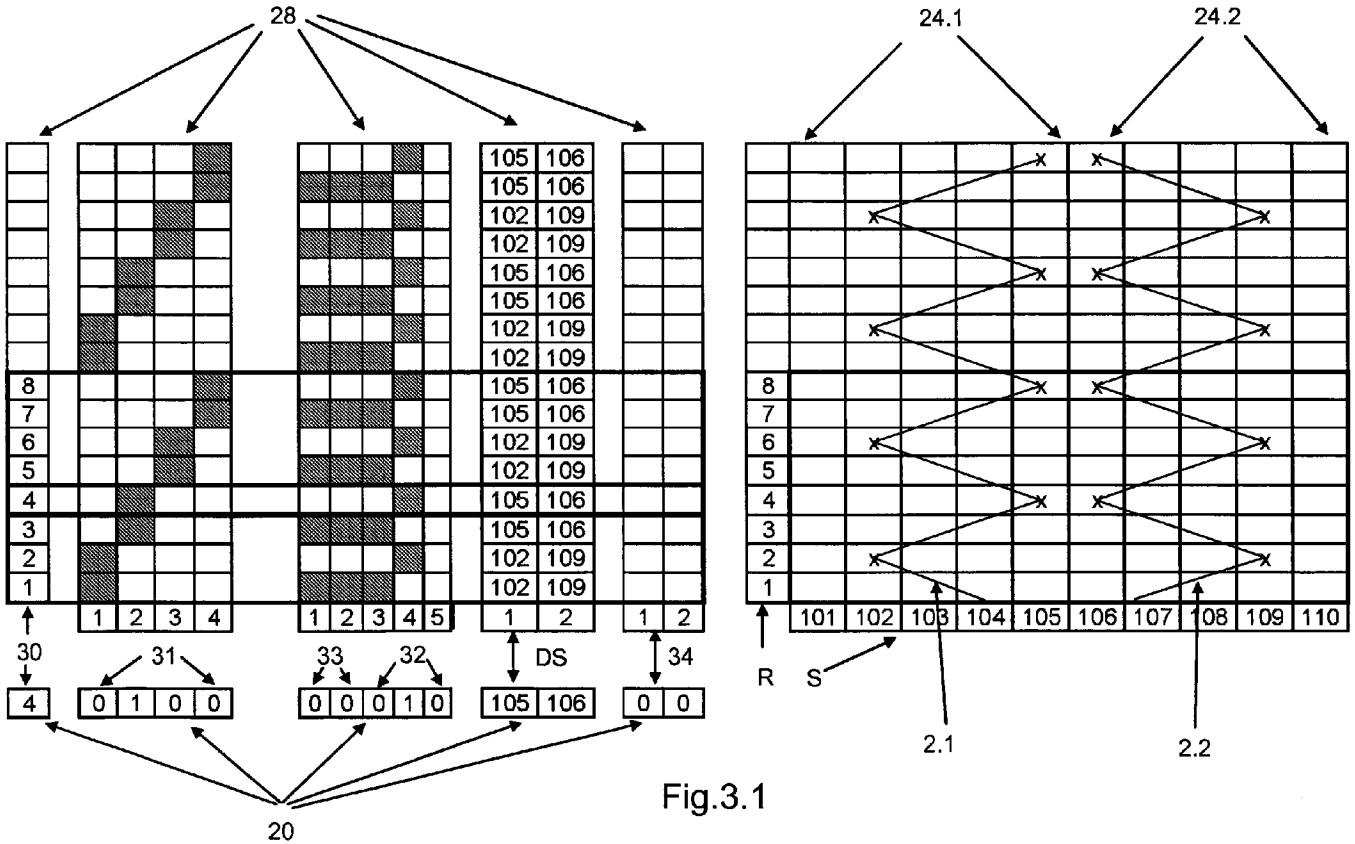
Fig.3.1

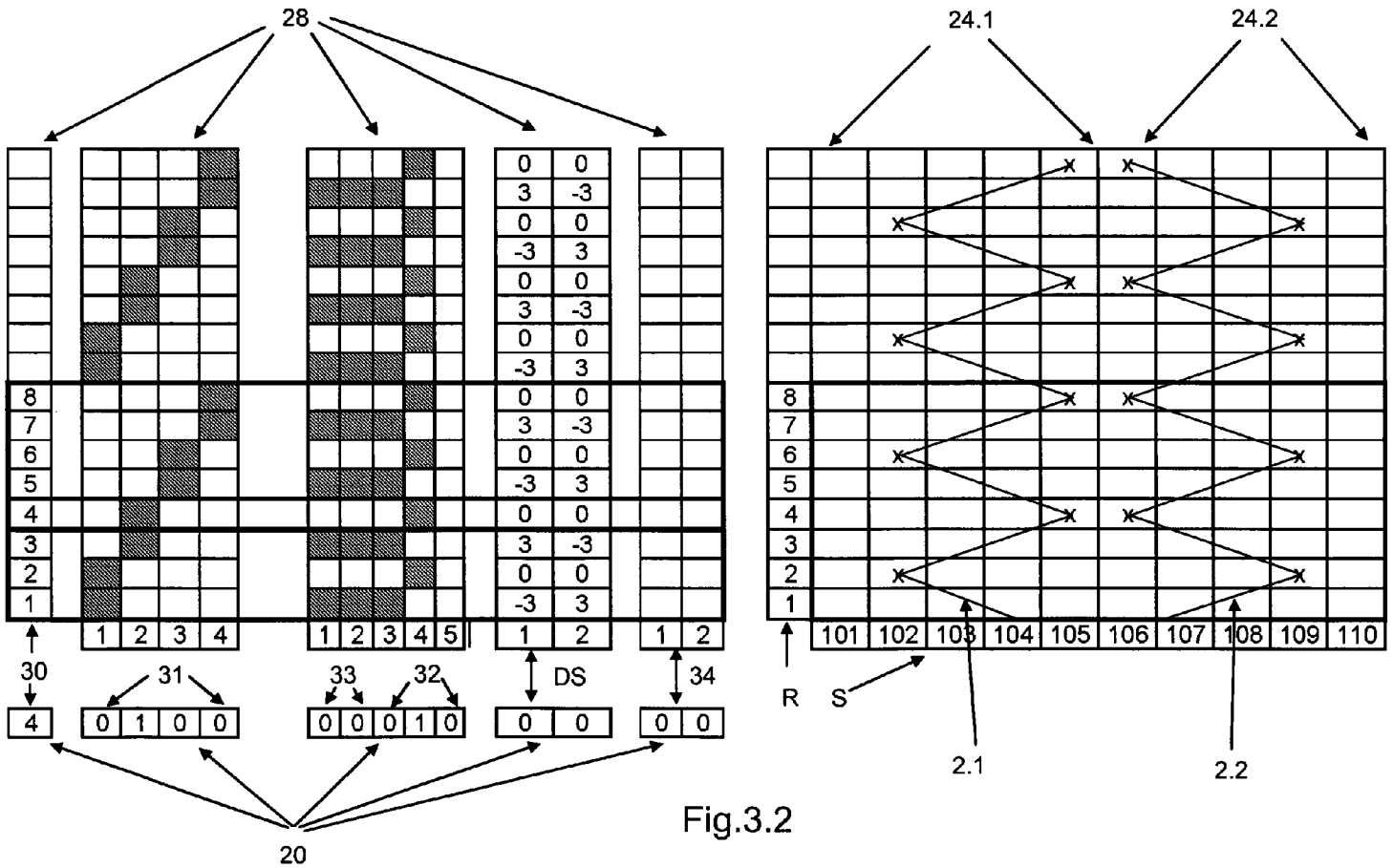
Fig.3.2

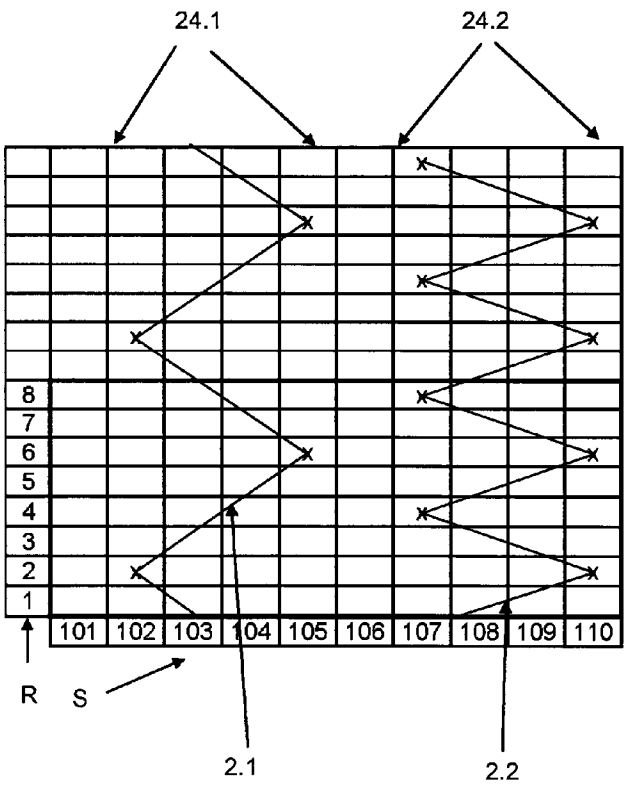
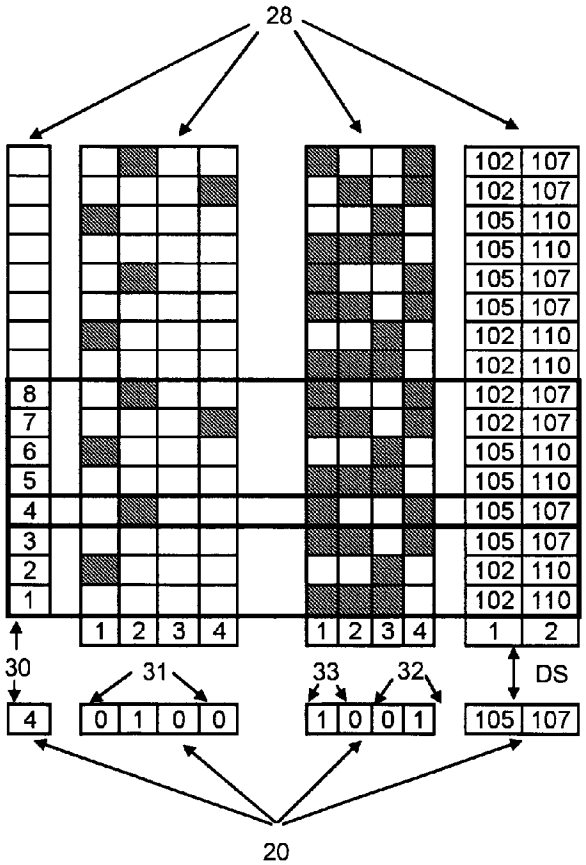
Fig.9

METHOD AND APPARATUS FOR WEAVING PATTERN FORMATION IN WOVEN FABRICS WITH ADDITIONAL WEFT EFFECTS

CROSS REFERENCE TO RELATED APPLICATIONS

This application is the 35 USC 371 National Stage of PCT International Application PCT/EP2011/057131 as filed on 4 May 2011, and claims the 35 USC 119 priority of German Patent Application 10 2010 026 609.4 as filed on 9 Jul. 2010.

FIELD OF THE INVENTION

The present invention relates to a method for producing data sets for weaving pattern formation in woven fabrics with additional weft effects as well as a weaving machine with means for the input, display, storage and processing of such data sets.

BACKGROUND INFORMATION

In weaving machines it is known in the prior art to involve additional threads, which essentially extend in the warp direction, in the woven fabric weave or interlacing in such a manner, so that certain additional weft effects are achieved. For this purpose, these effect threads are brought into a different position in the weft direction before the insertion of a weft thread for each motion cycle of the weaving machine.

A method and a weaving machine for the production of woven fabrics with such additional weft effects are shown, for example, in the previously unpublished patent application DE 10 2010 007 048.3-26. The method according to DE 10 2010 007 048.3-26 is characterized in that an effect thread is positioned above the weft thread that is to be inserted, and thereby emerges in the vertical direction out of a reed gap that is formed by weaving reed blades or dents and that is upwardly open on one side. After a sliding displacement of the effect thread in the weft direction, it is positioned below a next weft thread that is to be inserted and thereby submerges into a different similarly-formed reed gap.

In order to produce the motion sequence according to the described method, a guide means of the effect thread is moved in a plane in the vertical direction and in the weft direction, wherein this plane lies between the shed forming means and a weaving reed device. Due to the emerging or submerging of the effect threads, it is possible to slidingly displace the effect thread in the position above the weft thread to be inserted, even over several reed gaps, and therewith passing over one or more warp threads, in the weft direction.

The weaving machine according to DE 10 2010 007 048.3-26 includes a sliding displacement drive, which drives a sliding displacement device in the weft direction, on which sliding displacement device at least one guide means is provided, with which an effect thread can be slidingly displaced in the weft direction and vertically positioned. In that regard, various different sliding displacements of the effect thread in the weft direction can be prescribed via the sliding displacement drive for various different motion cycles of the weaving machine. Typically, the motion sequence that is carried out from one beat-up of a weaving reed device against a woven fabric edge up to the next such beat-up is designated as one motion cycle of a weaving machine.

A further aspect disclosed in the DE 10 2010 007 048.3-26 consists in that, for each motion cycle of the weaving machine, it can be prescribed by means of a mechanical or an electronic interlacing pattern draft, whether, during the weft insertion, the guide means with the effect thread is located above (in the upper shed) or below (in the lower shed) from the weft thread to be inserted. In that regard, the vertical positioning of the guide means with the effect thread is derived from a shedding means that is connected via shedding drives with a shedding machine.

It is known to a person skilled in the art, how to draft or design an interlacing pattern draft for weave patterns in the typical base or ground weaves. In that regard, in the simplest case, a pattern repeat of a woven fabric area is defined as a weave raster area and depicted graphically, if applicable. The pattern repeat is determined by a partial area of the weaving pattern, which occurs repetitively within the entire woven fabric. In order to depict the weaving pattern within the weave raster area, as a vicarious representation or substitution for each crossing point between warp and weft threads, weave raster fields are filled or not filled depending on whether the respective applicable warp thread at the crossing point lies above or below the weft thread in the woven fabric. It is also known to produce a punched card for the control of mechanical shedding machines, based on an interlacing pattern draft defined in such a manner. Predominantly electronic shedding machines operate in modern weaving machines, for the control of which it is typical to produce the interlacing pattern draft graphically on a computer display screen with the aid of a computer program, to convert it into a collection of electronically processible data sets, and to store it either in a memory means of the control device on a weaving machine or on an external memory or storage medium. In the control device of the weaving machine, by means of a further computer program, these data sets of an interlacing pattern draft are converted into control commands to the devices of the weaving machine for weave pattern formation. It is also typical to supplement such electronic interlacing pattern drafts in the form of data sets with further electronically processible instructions or informations for the control of the weaving machine. In that manner there arises a pattern draft with data sets for the control of the weaving machine for the production of a certain woven fabric.

The technical reference book "Die Weberei" (The Weaving) by E. Gräbner, 13th Edition, Leipzig 1953 discloses the representation of the weaving pattern formation on a weaving machine with additional weft effects. The production of brocade-like additional weft effects with the aid of needle bars or fallers is described on the pages 232 to 233. In this regard, however, the guide means (needles) for effect threads are located between the two end positions of a beat-up motion of the reed dents, and the reed dents also do not form reed gaps that are upwardly open, into which the effect thread submerges or emerges. On such a weaving machine, the sliding displacement of the needles in the weft direction is derived from mechanical pin cards, which comprise pins with differing length. The cited text citation discloses an operating auxiliary assistant or device that is supposed to be suitable for the determination of the pin lengths and pin sequences in a pattern repeat.

In the prior art it is not disclosed how a pattern draft for woven fabrics with additional weft effects is to be produced, which, besides the interlacing data, still additionally includes data sets for the control of guide means for the effect threads in the weft direction and vertically.

SUMMARY OF THE INVENTION

It is an object of the present invention to provide a method for producing data sets for the weaving pattern formation of a weaving machine with additional weft effects. Furthermore, a weaving machine with devices for converting or transforming such data sets into a weaving pattern is to be provided. The objects of the invention can be achieved by inventive embodiments of a method as well as inventive embodiments of a weaving machine as disclosed and claimed herein.

The weaving pattern formation in a weaving machine with additional weft effects according to an embodiment of the invention is controlled by means of data sets that are previously derived from the weaving pattern of a woven fabric with additional weft effects. In that regard, the woven fabric consists of weft threads, warp threads and at least one effect thread that forms crossing points with the weft threads, which lie on the backside or on the front side of the weft threads in the woven fabric. The crossing points that lie on the backside of the weft threads in the woven fabric are referred to as interlacing points in the present patent application, while the term crossing points is maintained for the crossing points that lie on the front side.

In this regard, the weaving patterns with additional weft effects used in the scope of an embodiment of the present invention are of the type that several such interlacing points are present, between which several warp threads lie in the woven fabric. That means that the effect thread extends diagonally passing over several warp threads, before it is again bound-in with a weft thread. The production of the data sets is carried out with the following method steps:

- fixing or specifying a woven fabric area that represents a pattern repeat and that extends in a weft direction and in a warp direction of the woven fabric;
- producing data sets, in that a data set comprising several data values is produced for each position of an interlacing point in the pattern repeat. In that regard, a first data value is derived from a weft sequence number of the weft thread of this interlacing point in the pattern repeat, while a second data value is derived from the position of the applicable interlacing point in the weft direction of the pattern repeat;
- supplementing these data sets by further data values derived from the weaving pattern, so that the data sets form a pattern draft for the weaving pattern;
- storing these data sets in a memory means of a control device of a weaving machine.

In this regard, the definition first and second data value does not specify a necessary physical sequence of data values. The first data value is sometimes referred to as the data value of the weft sequence number in this patent application, while the second data value is sometimes referred to as the data value of the additional weft effects.

In order that sufficient time is available for carrying out the sliding displacement motion even in fast-running weaving machines, in an advantageous embodiment of the inventive method, the data values of the additional weft effects are already produced and stored in data sets of previous motion cycles, even if no interlacing point is formed in these motion cycles.

It is advantageous, if the data value of the additional weft effects is equal to a geometric spacing distance in the weft direction of the interlacing point from a reference line extending in the warp direction in the woven fabric. This reference line can be the woven fabric edge or the edge of the pattern repeat or any desired line specified by the operator, for example a line extending along a warp thread. This specification leads to an absolute addressing of the position of the interlacing points in the woven fabric or in the pattern repeat.

However, an embodiment of the inventive method is also possible, in which the position of the interlacing points is respectively specified in relation to the position of the previous interlacing point in the pattern repeat. In this regard, the data value of the additional weft effects is calculated from the difference of two geometric spacing distances of interlacing points in the weft direction.

Besides the derivation of the data value of the additional weft effects from geometric spacing distances, a further variant of the inventive method is suggested. This is based on that a denting or reeding of the warp threads of the woven fabric into reed gaps of a reed on a weaving reed device of a weaving machine is allocated to the pattern repeat. Furthermore, a reed separation or division of the reed is determined. This is determined or specified by the geometric spacing distance between two reed gaps. For example, if the warp threads of the pattern repeat are drawn into 100 reed gaps, and if the width of the pattern repeat in the reed amounts to 100 mm, then there arises a reed division of 100 mm/100=1 mm from one reed gap to the next. The pattern repeat may now be divided in the weft direction into columns of a raster, which are 1 mm wide in the example assumed here. Each one of these columns corresponds to a position of a reed gap when forming the weaving pattern on a weaving machine. If now a characteristic reference indicium is allocated to each reed gap, for example on the basis of an increasing or decreasing number sequence, then the position of an interlacing point in the pattern repeat can be specified in relation to the characteristic reference indicium of a reed gap. The data value of the additional weft effects is derived from this characteristic reference indicium of a reed gap. This method has advantages in the use of inventively produced data sets on a weaving machine, in which the effect threads submerge into a reed gap for forming an interlacing point with a weft thread.

Also in this case, instead of an absolute addressing of the position of the interlacing points, a relative addressing or producing of data values of the additional weft effects is possible. In that regard, these arise from the difference between the number of the current reed gap and the number of a second reed gap, for example the number that describes the position of the previous interlacing point in the pattern repeat. However, for the difference formation, the number of a previously determined reference reed gap can be used, which is the same for all interlacing points of an effect thread in the pattern repeat.

If several effect threads with different interlacing points are involved in the weaving pattern formation within a pattern repeat, then a further advantageous modification of the inventive method is suggested. In that regard, in the pattern repeat, the different positions of the interlacing points for different effect threads are determined with the same weft thread. By using previously described method steps, a second and further data values for additional weft effects are derived from these positions, and are allocated to the data value of the weft sequence number in the respective data set. However, this is only necessary if several effect threads form additional weft effects of which the contours do not extend parallel to one another. That means that the guide means of the effect threads must be drivable independently of one another.

If several effect threads are involved in the weaving pattern formation within a pattern repeat, then for each effect thread its own reference line or its own reference reed gap can be specified. The indications or informations regarding the position of the reference lines or reference reed gaps in the pattern repeat or in the woven fabric must then, however, be added to the sum of all data sets of a pattern repeat, so that the necessary control commands for the pattern formation can be calculated from these indications or informations in the weaving machine.

The weaving pattern of the woven fabrics used here is determined by the position of the interlacing points of the effect threads with the weft threads in the woven fabric on the back side, i.e. below the weft threads. The position of the crossing points on the front side, i.e. above the weft threads, arises from the running path of the effect thread between two interlacing points. The sliding displacement of the effect thread in the weft direction from one to the next interlacing point can only take place in the weaving process in an inventive weaving machine when the effect threads are thereby located above the warp threads. This is the case when the effect thread is emerged out of a reed gap. The sliding displacement device of the weaving machine must move to the reed gap into which the effect thread will next submerge, in order to come to a position lying below the next weft thread that is to be inserted. That is to say, the downward motion of the effect thread can only begin when it is in the position of the next interlacing point.

An advantageous further embodiment of the inventive method is achieved by determining the position of the effect thread or effect threads at the interlacing points and at the crossing points in the pattern repeat. For each effect thread, a data value of the effect weave is added to the data set, whereby the position of the effect thread at this interlacing or crossing point, from the view of the observer on the front side or on the back side of the woven fabric, that is to say above or below the respective weft thread, is described by this data value. In that regard it must be taken into account, that the position of the effect thread in the respective motion cycle on the front or on the back side of the woven fabric is to be specified even for motion cycles in which no weft thread shall be inserted, even though no true crossing points with a weft thread are formed here. This data value of the effect weave is used in the weaving machine, in order to control the drives for the vertical position of the guide means of the effect thread.

Finally, a further advantageous embodiment of the inventive method provides that each data set is supplemented with further data values derived from the weaving pattern in such a manner that the data sets form a pattern draft for the weaving pattern. Such data values to be supplemented are to be specified by an operator skilled in the art, who produces the data sets for the weaving pattern, corresponding to the requirements that the woven fabric and the weaving machine demand. Those can, for example, be data values that are determined by the selection of the weft color or the weft thread type for each weft thread in the pattern repeat. In the following, these are referred to as data values of the selection weft thread type.

In the case of the use of an electronically controlled shedding machine it is sensible to supplement the pattern draft of a weaving pattern with additional weft effects through the indications for the shed formation for the base or ground weave between warp and weft threads of the woven fabric, that is to say by an interlacing pattern draft. In that regard, in the manner that is known from the prior art, the shedding means are numbered and a drawing-in of groups of warp threads into the shedding means is defined, and positions of the groups of warp threads drawn into the respective shedding means, above, that is to say on the front side, or below, that is to say on the back side, of the respective weft thread in the pattern repeat are determined and represented in the interlacing pattern draft. The usually graphically represented interlacing pattern draft is converted into electronically processible alphanumeric data values of the ground weave, which are supplemented in the data sets of a pattern draft.

The data sets for a pattern repeat include indications or informations for a small cut-out section of the woven fabric, of which the weaving pattern, however, generally repeats multiple times on the larger total area of a woven fabric web. For these repetitions of the pattern repeat, additional data values are supplemented in the data sets if applicable. It is typical to input these data values as that number of motion cycles of the weaving machine, after which the weaving pattern of the pattern repeat is repeated. For patterns with additional weft effects, which repeat over the width of the woven fabric in the weft direction, additional indications or informations are to be provided if applicable. That can, for example, be the number of geometric units or reed gaps after which an additional weft effect shall repeat in the weft direction.

Finally it is advantageous to summarize or collect together one or more pattern drafts with further data values, which relate to the woven fabric and the associated adjustments of the weaving machine, to a set of article data. That can be data values for additional functions, such as, for example, informations as to the warp tensions and as to the rotational speed. But also informations as to the drawing-in width in the reed, as to the reed division, and as to the position of, if applicable previously defined, reference lines or reference reed gaps for the additional weft effects in relation to the position of the sliding displacement devices for the guide means in the weaving machine, can be indicated in the article data. These article data are to be determined by an operator skilled in the art, who produces the data sets for the weaving pattern, corresponding to the requirements that the woven fabric and the weaving machine demand.

In the method according to an embodiment of the invention it is finally advantageous, if the pattern draft is graphically or tabularly depicted. This graphic depiction or representation is carried out, for example, with similarity to the known depiction or representation of an interlacing pattern draft for a weaving pattern in rows and columns of one or more raster areas, whereby the raster fields of these raster areas are graphically or alphanumerically filled with informations, which are derived from the inventively produced data sets. The illustration or representation can be carried out by the operator in the manner of a drawing on a sheet of paper. In an advantageous embodiment of the inventive method, however, the generation or production and the representation of the data sets is carried out with the aid of a computer program, which allows the interactive input and output of graphic symbols or alphanumeric characters in data fields, for example in interlacing raster fields of a graphically depicted interlacing pattern draft on a computer display screen. Such an interactive input and output is carried out in the manner that is typical in the operation of such computer programs via the selection of data or interlacing raster fields on the computer display screen by means of a cursor and with input commands per mouse click or via the keyboard in these data or interlacing raster fields.

Moreover, for the production of the data sets from the provided positions of the interlacing points in the pattern repeat, the formation of a graphically depictable effect raster on the area of the pattern repeat can be helpful. In this regard, this effect raster formation occurs in the following steps:

- definition of an effect raster area, which is formed on the area of the pattern repeat in the weft and in the warp direction by means of checkerboard-like arranged raster fields in such a manner that
- raster rows arise, which follow one after another in the warp direction, whereby the raster rows are characterized or referenced with the weft sequence numbers in the pattern repeat;

raster columns arise, which follow one after another in the weft direction, whereby the number of the raster columns is calculated from a prescribed raster division in the weft direction and the width of the pattern repeat in the weft direction;

definition of an unambiguous characteristic reference indicium for each raster column as a multiple of a geometric unit or as a number of a reed gap.

Then interlacing points are specified in the raster area of the pattern repeat for the desired weaving pattern with additional weft effect. The first and the second data values of the associated data sets can be derived from the position of an interlacing point in the effect raster. This occurs in that the characteristic reference indicium of the raster row and the characteristic reference indicium of the raster column are evaluated, in which the raster field lies, in which the respective interlacing point is located. The weft sequence numbers with which the raster rows are referenced correspond to the number of motion cycles that are carried out by the weaving machine for the woven fabric formation of the pattern repeat. The weft sequence numbers are only identical with the numbers of weft threads that are actually present in the pattern repeat of the woven fabric, if no motion cycles without weft insertion (lost pick or empty weft shot) are provided in the weaving pattern formation.

A first data value is now derived from the characteristic reference indicium of the raster row of the interlacing point in the effect raster, that is to say from the pertinent weft sequence number in the pattern repeat, while a data value of the additional weft effects is derived from the respectively determined characteristic reference indicium of the raster column. For the depiction or representation of such an effect raster area and for the derivation of the data sets from the positions of the interlacing points in this effect raster area, the use of an expanded embodiment of the already mentioned computer program is provided. In that regard, the number of raster rows and raster columns or a raster division of the effect raster are specified by inputs of the operator. Then, the symbols for the positions of the interlacing points in the effect raster are produced in the raster fields on a computer display screen by interactive input and output of graphic symbols or alphanumeric characters, and from that the data sets of a pattern draft for the weaving pattern are produced according to one or more embodiments of the inventive method.

After producing the data sets, if applicable a desired conversion of the alphanumeric data sets into a defined data format that is processible by the control device of a weaving machine for the weaving pattern formation, is carried out with the aid of a computer program. In this regard, if applicable also still additional data set characteristics or indicia can be supplemented, which are required for the electronic processing. The produced data sets and, if applicable, the article data are stored on an exchangeable memory storage medium in a further embodiment of the inventive method. Than can, for example, be a floppy diskette or a USB stick or a CD data carrier disk.

When the data sets are produced with the aid of the inventive method directly on the weaving machine, then the storage takes place in a memory storage medium of a control device of the weaving machine.

A weaving machine according to an embodiment of the present invention includes at least one guide means for an effect thread, which is connected with a sliding displacement device and a sliding displacement drive. Thereby, the effect thread together with the guide means is slidably displaceable in a weft direction by a sliding displacement that is prescribed by a weaving pattern. It is familiar to the person skilled in the art that the term weft direction means both oppositely directed directions extending parallel to the weft insertion on the weaving machine. Furthermore, on the inventive weaving machine, there are provided devices for the weaving pattern dependent vertical motion of the guide means, as well as a weaving reed device for beating-up the weft thread against a woven fabric edge by means of a beat-up motion that comprises two end positions. The weaving reed device comprises weaving reed blades or dents, which form one-sided upwardly open first and further reed gaps in such a manner, that the effect thread can submerge into and emerge from these reed gaps. Finally, the weaving machine is equipped with a control device, with input means and with memory means, which are connected for signal transmission with the control device as well as with the sliding displacement drive. Furthermore it is provided that a computer program is present in the control device, with which a data set stored in the memory means can be allocated to each respective motion cycle of the weaving machine, and with which the respective sliding displacement can be calculated from the allocated data set. In the inventive weaving machine, for this process, such data sets are utilized that have been produced with the above described inventive method.

The data sets can, for example, be produced via the input means of the weaving machine with the aid of a computer program according to an advantageous embodiment of the inventive method, displayed on a display screen and stored in the storage or memory means of the control device. On modern weaving machines, the input means consist of computer display screen, keyboard and if applicable read-in means for exchangeable memory media, whereby the computer display screen usually allows the operator to select data fields directly with the finger of a hand. In the scope of the invention it is also possible to produce data sets on an external computer with the aid of the inventive method, to store the data sets on an exchangeable memory medium, and to read-in the data sets into the memory means of the weaving machine via read-in means.

Warp threads and shedding means for forming a loom shed bounded by the warp threads are present on a weaving machine. The shedding means are driven by a shedding machine for producing a ground weave interlacing between warp and weft threads. It is now advantageous to embody the device for the vertical motion of the guide means in such a manner that the sliding displacement device and the sliding displacement drive are connected with a shedding means, which is drivable by a shedding machine, which is connected with the control device in a signal transmitting manner. The guide means is positionable above or below a weft thread that is to be inserted within a motion cycle, by the shedding means dependent on the data of the data set. One embodiment of the weaving machine according to the invention provides that the guide means for the effect thread or the effect threads is slidably displaceable and vertically movable in a plane that lies between the shedding means and the respective end position of the beat-up motion that is closer to the shedding means. That is the end position during the weft insertion.

BRIEF DESCRIPTION OF THE DRAWINGS

In the following, advantageous embodiments of the invention are explained in detail with the aid of the Figures as follows.

DETAILED DESCRIPTION OF EXAMPLE EMBODIMENTS OF THE INVENTION

Figure 1:
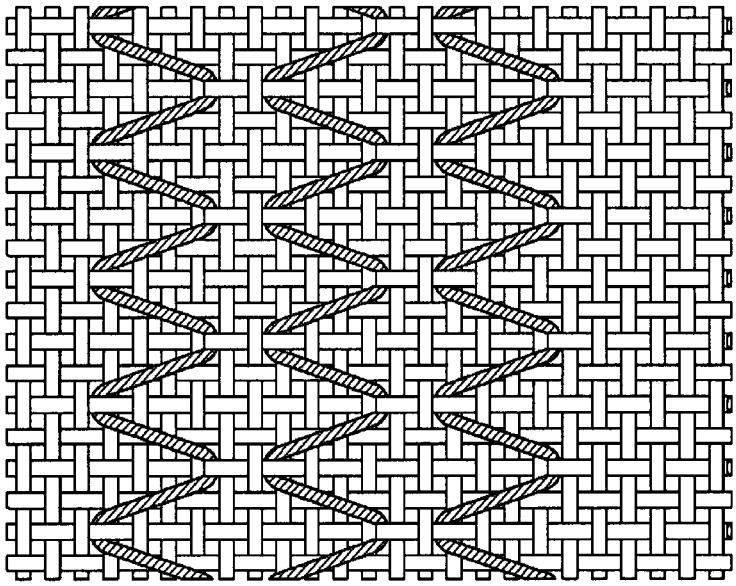
FIG. 1 example of a woven fabric with additional weft effects with three effect threads, FIG. 2.1 woven fabric with additional weft effect with one effect thread, FIG. 2.2 woven fabric according to FIG. 2.1 with effect raster area, FIG. 3.1 pattern draft and example data set, which were produced with an example embodiment of the inventive method. Example of an effect raster area as a starting basis for producing the data sets of the pattern draft, FIG. 3.2 like FIG. 3.1, however with formation of the data sets for the position of the interlacing points from difference values of the raster columns, FIG. 4 like FIG. 3.1, however with lost picks or empty weft shots and respectively one reference line in the effect raster areas for each effect thread, FIG. 5 schematic illustration of an inventive weaving machine with view direction in weft direction, FIG. 6 schematic illustration of an inventive weaving machine, with view direction from above, FIG. 7 graphical illustration like in FIG. 3.1, however based on a woven fabric with floating of an effect thread on the top in the warp direction, FIG. 8 graphical illustration like in FIG. 3.1, however based on a woven fabric with floating of an effect thread on the bottom in the warp direction, FIG. 9 graphical illustration like in FIG. 3.1, however based on a woven fabric with floating on the top in the warp and weft direction.

The FIG. 1 shows a weaving pattern with additional weft effects with three different effect threads 2.

The FIG. 2.1 shows a woven fabric 26 with an effect thread 2, with warp threads 1 and with weft threads 3. A pattern repeat 29 is illustrated, as well as interlacing points P of the effect thread 2 with weft threads 3. In this regard, here only the points at which the effect thread 2 crosses with the weft thread 3 on the back side thereof, thus lies below the weft thread 3, are referred to as interlacing points P. Crossing points between effect threads 2 and weft threads 3 that lie on the front side, thus above the weft thread 3, are referenced with K.

FIG. 2.2 shows the associated effect raster area 24 of the pattern repeat 29 of the FIG. 2.1 with raster fields 25.

The pattern repeat 29 in the warp direction in the present case is assumed with eight weft threads 3. For more complex and longer additional weft effects, naturally pattern repeats 29 over considerably more weft threads 3 are also conceivable. The characterizing reference indicia of the raster rows R arise from the weft sequence numbers 1 to 8 of the weft threads 3 in the pattern repeat 29.

In the weft direction 12, the pattern repeat 29 is determined by the arrangement of the additional weft effect of an effect thread 2. The raster division TS of the effect raster area 24 is here selected like the warp division as an example. With a simple or single drawing-in of the warp threads 1 of this woven fabric 26 into the reed gaps 14 of a weaving reed device 7, 7.1, 10 of a weaving machine, the raster division TS selected for this example is also equivalent to a reed division TR. In the present pattern repeat 29, seven raster columns arise from the selected raster division TS and the width of the pattern repeat 29. With a simple or single reed denting or drawing-in, this would be equivalent to seven reed gaps 14 of a weaving reed device 7, 7.1, 10. However, within the scope of the invention, other raster divisions TS can also be selected. Especially for very fine weaving patterns with tight or dense warp end spacings, it can be sensible to use a geometric unit, for example "mm", for the raster division TS. Then the position of the interlacing points P is simply measured on the woven fabric 26 with a ruler, or is prescribed by the designer for this weaving pattern in connection with a drawing. These positions P of the interlacing points in the woven fabric 26 are represented by the character X in the effect raster illustration in FIG. 2.2. Instead of the characteristic marks or reference indicia S with increasing numerals of an increasing or also decreasing number sequence, without difficulties also other characteristic marks or reference indicia S can be used, with which an unambiguous allocation of the raster columns is possible; thus for example a sequence of letters A, B, C, D or combinations of letters and numbers, e.g. A1, A2, A3 etc. The embodiment of the inventive method, in which a current data value of the additional weft effects is calculated from the difference from a previous data value, is, however, not suitable for all such characteristic marks or reference indicia S.

The left half of the FIG. 3.1 shows the graphical illustration of a pattern draft 28 with data sets 20 that were produced according to an example embodiment of the inventive method. The type of illustration corresponds to that with which the person skilled in the art is familiar, but it merely represents an example.

The right half of the FIG. 3.1 shows an effect raster area 24 of the pattern repeat 29, that was formed for deriving the pattern draft 28 and the data values of the data set 20 from the positions of the interlacing points P in warp and weft direction 12 of the pattern repeat 29.

In the Figures, which illustrate pattern drafts and effect raster areas, the pattern repeat 29 is respectively bordered or surrounded with a thicker line.

Below the graphical illustration of the pattern draft 28, the example of a single data set 20 is illustrated, of which the data values are respectively allocated to the graphical illustration of the pattern draft 28 thereabove. In the present case, the data set 20 is illustrated, which was produced for the weft sequence number 4 in the pattern repeat 29. The rows following one after another in the warp direction in the pattern draft 28 are characterized in the first column 30 of the pattern draft 28. Each row of the pattern draft 28 represents one motion cycle of the weaving machine in a weaving pattern formation according to this pattern draft 28. For each one of the motion cycles, one data set 20 is produced and stored, whereby in the scope of the present invention, a first data value 30 of this data set 20 is formed from the respective weft sequence number of the pattern repeat 29 and is stored in the column 30. Here, the weft sequence numbers are defined by the numbers 1 to 8.

The columns numbered with 1 to 4 over the data values of the selection weft thread type 31 serve for the graphical illustration familiar to the person skilled in the art, of a selection of the weft color or the weft thread type in the pattern draft 28 of the pattern repeat 29. Thus, the present weaving pattern includes four different weft thread types. A dark field in a row means that the weft thread type with the number of the associated column, is selected for the weft insertion in this motion cycle.

The columns numbered with 1 to 2 over the data values of the effect weave 33 contain the informations for the vertical motion of the guide means 11 with the effect threads 2 in the respective motion cycle. The columns numbered with 3 to 5 over the data values of the base or ground weave 32 contain the informations for the interlacing pattern draft of the ground weave, that is to say for the position of the shedding means 4 with groups of warp threads 1, whereby the column 5 has no function in the present example, because the ground weave of the present woven fabric 26 is to be carried out with only two shedding means 4.

The fields in the columns for the interlacing pattern draft are filled in dark when the respective shedding means 4 shall be located in the upper shed 1.1 or above a weft thread 3 that is to be inserted. This definition is familiar to the person skilled in the art of weaving.

For the electronic processing of the light and dark fields of the graphically illustrated pattern draft 28, in the example embodiment, the data value 1 is assumed instead of a dark field, while the data value 0 is assumed instead of a light field. This is shown in the alphanumeric representation 20 of a data set 20 below the pattern draft 28.

The inventive method of course also encompasses producing data sets 20 in which the dark and light fields in the pattern draft are transformed into other electronically processible, unambiguous numbers or characters. In the conversion or transformation of the graphical illustration of the pattern draft 28 into alphanumeric data sets 20, generally the numbers of the weft type and the numbers of the shedding means 4 below the associated columns of the graphically illustrated pattern draft 28 are not depicted by further data values in the data set 20, but rather by the position of the respective data value within the sequence of the data values in the data set 20.

Moreover, the person skilled in the art also knows illustrations or representations of pattern drafts 28 in which no data values of the weft sequence numbers 30 are shown, because these arise from the sequence of the successive rows in the graphically illustrated raster of the pattern draft 28. The first data values 30 of an inventive data set 20 can thus also be derived directly from this sequence. It is also clear that the illustrated alphanumeric or binary numbers or if applicable characters of the data set 20 can be brought into a different data format, e.g. into a hexadecimal format, for the storage on a memory storage medium or in a memory means 22. The transformation into such formats does not need to be separately illustrated here.

These and if applicable further necessary specifications or informations as to the internal construction and as to the data format of the data sets 20 must be taken into consideration in the reading-out and transforming or converting of the data sets 20 in the weaving machine later with a corresponding conversion or translation module in the computer program of the control device 8 of the weaving machine.

The illustration or representation of the pattern draft 28 in the left half of the FIG. 3.1 includes two columns DS, which are numbered with 1 and 2 at the bottom edge or border. These are the columns of the pattern draft 28 that contain the inventive data values of the additional weft effects DS, which are derived from the positions of the interlacing points P in the pattern repeat 29 in the weft and warp direction, and which serve, in the weaving machine, for the control of a sliding displacement drive 6 through a sliding displacement A. Just like in the column 30, the columns DS do not contain graphic symbols but instead alphanumeric data values DS. In the present example, the derivation of the data values is carried out with the aid of the effect raster area 24 illustrated or represented in the right half of FIG. 3.1. This effect raster area 24 is formed in the manner already described, from the pattern repeat 29 of the woven fabric 26 that is to be produced. Here, a reed gap division is assumed or used as the raster division TS in the weft direction 12. The characteristic reference marks or indicia of the raster columns S are defined by numbers of reed gaps 14. However, it would be just as easily possible to provide a raster division TS in multiples of geometric units, e.g. in mm.

The data values of the additional weft effects DS in the pattern draft 28 are derived from the characteristic reference marks or indicia S of the raster columns, which follow from the positions of the interlacing points X in the effect raster area 24 of the FIG. 3.1 for the effect threads number 2.1 and number 2.2 involved in the pattern repeat 29. The associated effect raster areas in the FIG. 3.1 are referenced with 24.1 and 24.2. The raster columns are numbered consecutively from 101 to 110. In that regard, the characteristic reference mark or indicium 101 for the first raster column shall mean that interlacing points X situated here are formed at the location in the woven fabric 26 at which the reed gap 14 with the number 101 is located. In the case of a raster division TS in the weft direction 12 in steps of 2 mm, the characteristic reference mark or indicium of the column 101 would mean that the interlacing point P is formed at a location in the woven fabric 26 that is spaced away from a reference line in the woven fabric 26 by 202 mm in the weft direction. The possible positions are dependent on the width of the woven fabric 26, the reed division TR, and the mechanically possible positions of the guide means 11 for the effect thread 2 in the weaving machine.

The two columns DS for the effect thread number 2.1 and for the effect thread number 2.2 are illustrated here next to one another. In the case of more than two effect threads 2 that are to be controlled independently from one another, correspondingly more of such columns DS are to be provided next to one another in the pattern draft 28. As already mentioned, other characteristic reference indicia S for the position of the interlacing points X in the raster columns are also possible here. Instead of the consecutive numbering from 101 to 110 it would also be conceivable to consecutively number the raster columns in the raster area 24.1 from 101 to 105 and from 201 to 205 in the raster area 24.2. Finally, still two further columns 34 follow in the pattern draft illustration of the FIG. 3.1. In the present example these are empty. However, if needed, data values for additional functions 34 can still further be indicated here, which control various other functions of the weaving machine in each motion cycle, e.g. the warp tension or the weft spacing, which can be varied within a pattern repeat 29 if needed for various weaving pattern effects. The graphic illustration or representation of the effect raster area 24 in FIG. 3.1 is not a component part of the pattern draft 28, but rather is an auxiliary construction, which aids in the derivation of the pattern draft 28 and the data values in an inventive manner from the pattern repeat 29 of a woven fabric 26. This effect raster area 24 is not decisive for the inventive method, but rather merely a component part of an advantageous embodiment.

FIG. 3.2 shows a variation of the illustration according to FIG. 3.1, whereby here the data values of the additional weft effects DS are derived from the positions of the interlacing points P in a different variant of the inventive method. In this regard, values have been produced as data values in the columns DS of the pattern draft 28, which have first been formed by a conversion calculation from the characterizing reference indicia S of the raster columns of an effect raster area 24, namely by difference formation of two successive characterizing reference indicia S of raster columns, which each contain the position of an interlacing point X in the weft direction 12. With this difference formation, there arises in the data set 20, a data value that is not equal to the characterizing reference indicium S of the raster column, but rather contains a relative address of a raster column with reference to a preceding data set 20. Thus, the relative address represents the number of the raster columns or raster divisions TS that lie between two interlacing points X in the weft direction 12.

Therewith a control of the sliding displacement device 5 from interlacing point P to interlacing point P can take place in the weaving machine in a relative manner over a number of raster divisions TS that is prescribed by the data set 20. In that regard, it is irrelevant whether a geometric value or the number of a reed gap 14 is used as the raster division TS. If no sliding displacement is provided, then the applicable data value receives the value 0.

In order that these informations can be correctly transformed into control pulses for a sliding displacement drive 6 later during the reading-in and conversion in the weaving machine, the computer program used therefore still additionally needs an indication of the raster division TS on which the data sets 20 are based. This information can, for example, be supplemented or added to the data sets 20 of a pattern draft 28 for the weaving pattern, or can be previously set in the computer program.

It is advantageous to derive the vertical motion of the effect thread 2 in the weaving machine from the motion of a shedding means 4, which is driven by an electronic shedding machine 23, e.g. a dobby or shaft machine or an electronic Jacquard machine. In this case, the same shedding machine 23 can be used for producing the ground weave and for producing the vertical motion of the additional weft effect.

It is commonly known in the prior art, to use dobby or shaft machines or Jacquard machines in which each shedding means 4 can be located either only in the upper shed 1.1 or only in the lower shed 1.2 in each weaving cycle. Thereby, the motion of the shedding means 4 from the upper shed 1.1 into the lower shed 1.2 is already introduced in the respective preceding motion cycle. Therefore, when using such a dobby or shaft machine for the vertical motion of an effect thread 2 in the scope of an embodiment of the present invention it is to be taken into consideration, that after a sliding displacement of the effect thread 2 in weft direction 12, the effect thread 2 can be brought into a position below the next weft thread 3 that is to be inserted, only in the second successive motion cycle of the weaving machine following thereafter, in order to form an interlacing point P with this weft thread 3.

This limitation in the weaving pattern formation with interlacing points P in the pattern repeat 29 is omitted if the vertical motion of the effect thread 2 is derived from a shedding drive 9 that enables moving a shedding means 4 and the guide means 11 secured thereon into the upper shed 1.1 and into the lower shed 1.2 within one motion cycle of the weaving machine. Such shedding drives 9 with individually programmable electric motor drives for the drive of each shedding means 4, e.g. heald frames or shafts, or heddles, are in the meantime also similarly available in the prior art.

In the pattern repeat 29 of the woven fabric example in the FIG. 3.1 it can be seen that the two effect threads 2.1 and 2.2 only form an interlacing point X in the pattern repeat 29 with each second weft of the weft sequence. This arises because, for the weave pattern formation of this woven fabric 26, it is provided that the vertical motion of the effect thread 2 in the weaving machine is derived from the motion of a shedding means 4, which is driven by an already previously explained electronic shedding machine 23, with which in each weaving cycle each shedding means 4 can be positioned either only in the upper shed 1.1 or only in the lower shed 1.2. The weft sequence of the present pattern draft 28 of the woven fabric example provides that a weft thread 3 is selected in each motion cycle. However, the interlacing points P arise in the described manner always in each second motion cycle or weft insertion cycle.

If a similar woven fabric 26 is to be produced, in which each weft thread 3 present in the woven fabric 26 forms an interlacing point P with the effect thread 2, then an empty weft insertion or lost pick, i.e. a motion cycle without insertion of a weft thread 3, must be provided in the pattern draft 28 of the pattern repeat 29 between the interlacing points P, whereby the shedding means 4 with the effect thread 2 is in the upper shed 1.1.

Figure 4:
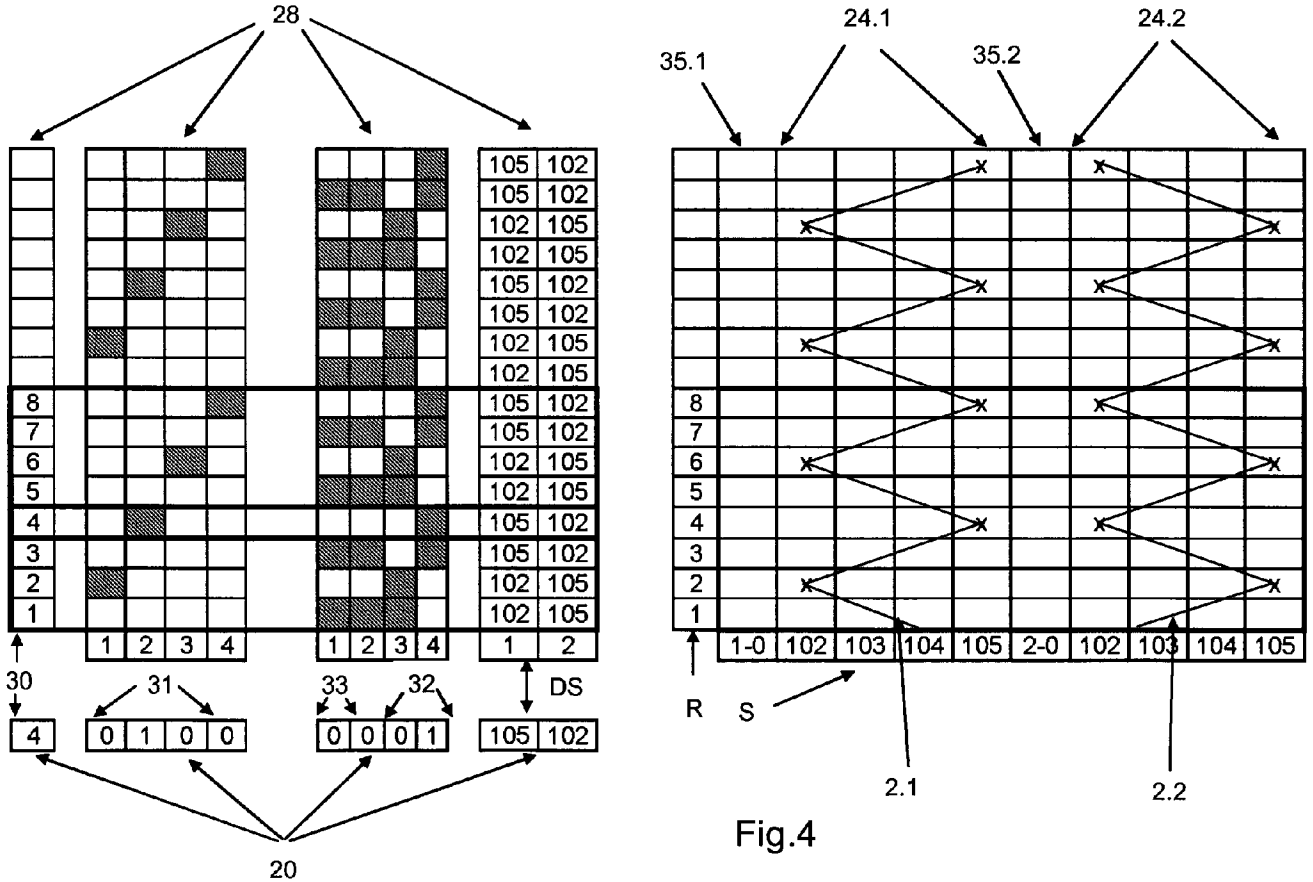

Such a pattern draft 28 is shown by FIG. 4. FIG. 4 also shows that it is possible to provide the same numbering of the raster columns, thus e.g. from 102 to 105, for both effect raster areas 24.1, 24.2, even though the interlacing points X of the two effect threads 2 in the pattern repeat 29 do not lie at the same position. In order that the allocation and transformation of the data values of this pattern draft 28 in the weaving machine can nonetheless be carried out unambiguously, two reference lines 35.1, 35.2 have been defined, which are respectively allocated to one of the two effect threads 2 and the data values of the additional weft effects DS that are valid or applicable thereto.

In this case, the pattern draft 28 of the pattern repeat 29 must still be supplemented with data values that contain the positions of the two reference lines 35.1, 35.2. For receiving such further data values, the sequence of data sets 20 of the pattern draft 28 still additionally receives a data block arranged in series before or after it, in which, if applicable via corresponding additional data values for each effect thread number 2.1, 2.2, it is specified at which position the reference line 35.1 or 35.2 with the characterizing reference indicium 1-0 or 2-0 for the respective effect thread 2.1 or 2.2 lies relative to the edge or border of the woven fabric 26. A data value with the raster division TS prescribed by the operator also belongs into this block.

Figure 5:
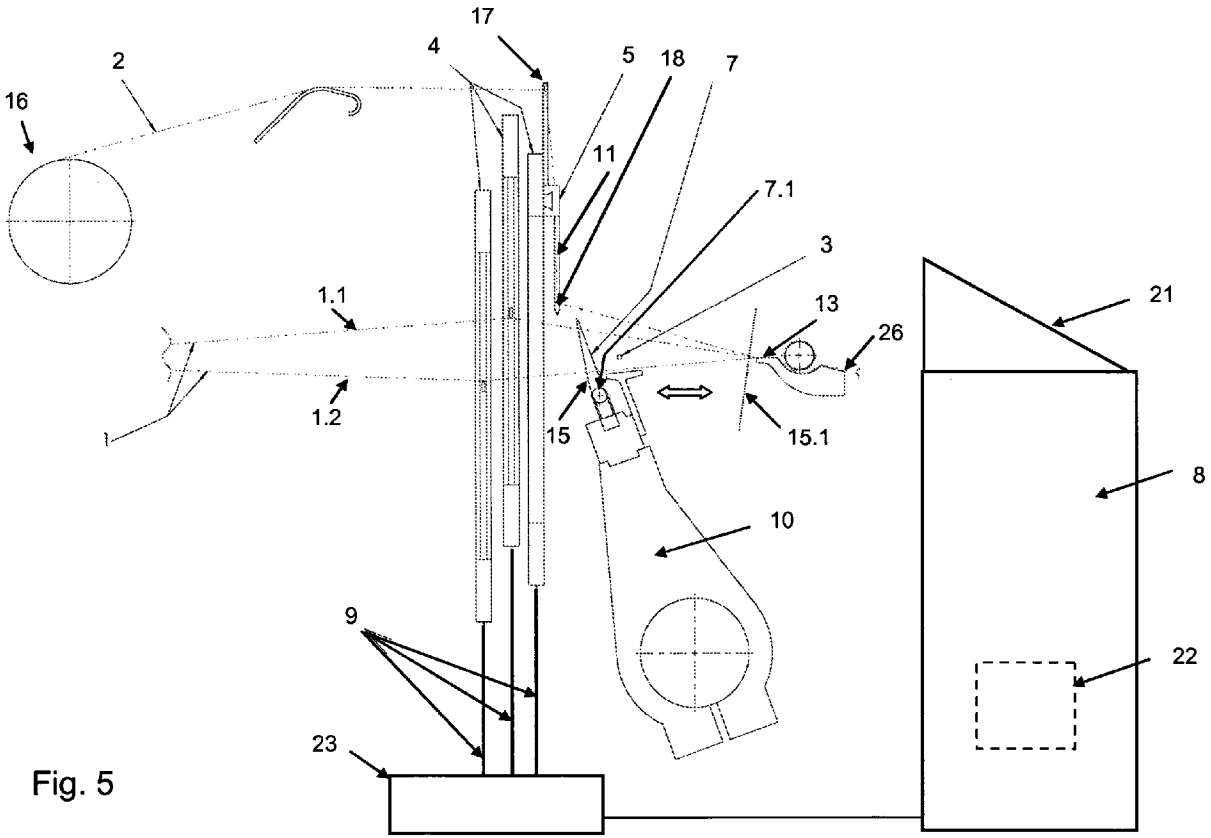
Figure 6:
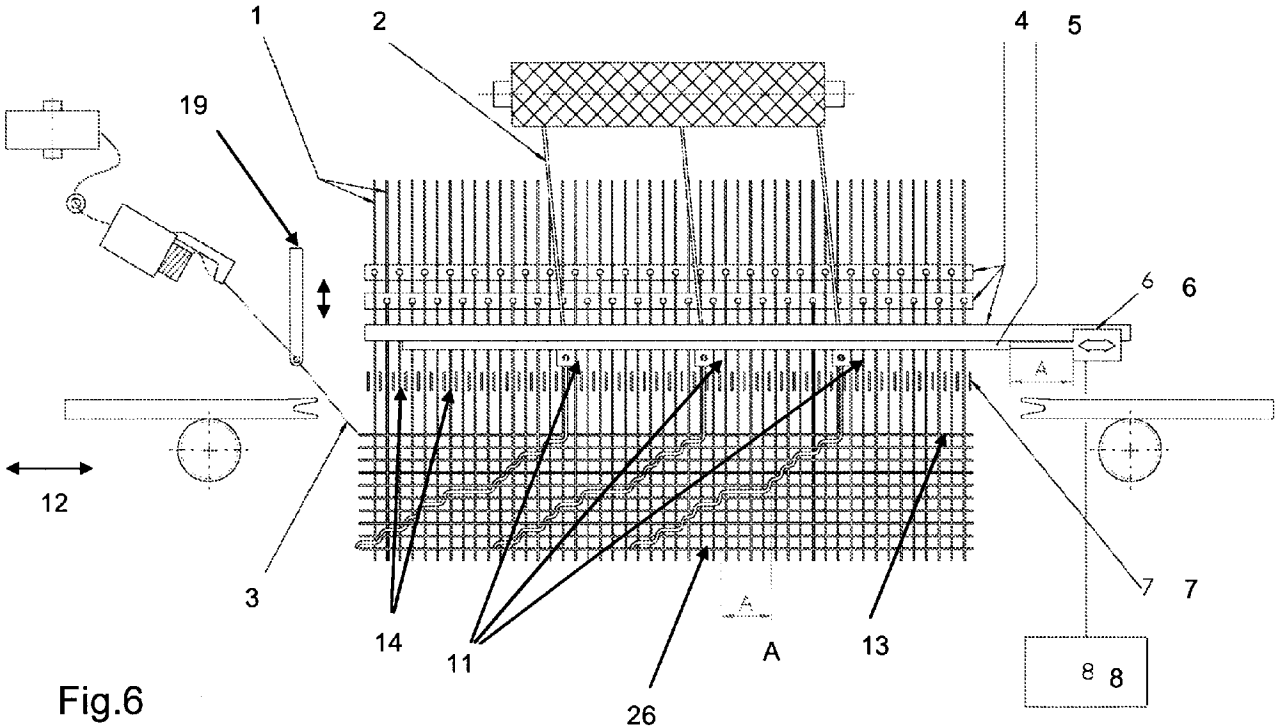

The FIGS. 5 and 6 show, in partial views, an inventive weaving machine with shedding drives 9 for driving shedding means 4, by the vertical motion of which a loom shed 1.1, 1.2 bounded by warp threads 1 is formed. The shedding drives 9, which are actually known as such to the person skilled in the art, can, for example, consist of a group or set of levers and rods that are arranged below the shedding means 4 and that transmit the drive motions of a shedding machine 23 to the shedding means 4.

In the present example, the shedding means 4 consist of known heald frames or shafts with heddles, through the heddle eyes of which the warp threads 1 are guided. Furthermore, devices for the insertion of a weft thread 3 into the loom shed 1.1, 1.2 in a weft direction 12 are provided. In the example in the FIGS. 5 and 6, a device with grippers is illustrated, which are pushed from both sides of the weaving machine into the loom shed 1.1, 1.2 in a known manner by transmissions that are not shown and two drive wheels. In this example embodiment, the weft thread 3 is delivered to one of the two grippers from a weft bobbin via a pre-spooler and a selection device for the weft thread type 19, and is transferred to the other gripper in the middle of the machine. Naturally, the use of various different weft thread types for different motion cycles is also conceivable. The selection and presentation of the weft threads 3 to a gripper is carried out, for example, by means of a selection device for the weft thread type 19. Such detailed embodiments are known to the person skilled in the art. The control device 8 of the weaving machine is further equipped with input means 21 and memory means 22. The devices for the weft insertion on an inventive weaving machine can naturally also be embodied as weaving shuttles, projectiles or devices for the pneumatic weft insertion.

Any other desired electric-motor, electro-hydraulic or electro-pneumatic devices can also be used as shedding drives 9 or shedding machine 23 for the drive for the vertical motion of shedding means 4 or guide means 11.

In principle, a purely mechanical device for the vertical motion of shedding means 4 or guide means 11 can also be used. That may, for example, be a so-called eccentric machine with which the vertical motions are derived from cam disks, which are differently configured and exchangeable for the weave pattern formation for various different weaves. Therewith, however, a derivation of these vertical motions from data sets 20 in the control device 8 of a weaving machine is not possible.

A weaving reed device 7, 7.1, 10 for beating-up the weft thread 3 against a fabric edge 13 is furthermore provided in the weaving machine according to the FIGS. 5 and 6. The weaving reed device 7, 7.1, 10 consists of a reed support 10 with reed blades or dents 7 and a reed band 7.1. These reed blades 7 form, therebetween, one-sided upwardly open receiving spaces, so-called reed gaps 14, so that threads that extend in the direction of the warp threads 1 from the rear toward the front through the weaving machine dive or submerge from the top into these reed gaps 14 and thus can be guided in the weft direction 12 by the reed blades 7.

The reed blades 7 are secured by the reed band 7.1 on the reed support 10, and together with this, carry out a beat-up motion 15-15.1 in each motion cycle of the weaving machine. Finally, in the present example embodiment according to the FIGS. 5 and 6, a sliding displacement device 5 with a prism guide is arranged on the frame of the heald frame or shaft, on which three guide means 11 are arranged, with which three effect threads 2 can be slidingly displaced by the distance A in the weft direction 12. Instead of the prism guide, of course any other type of linear guide can be used, which ensures a precise positioning of the guide means 11.

In the present example embodiment, needles with thread eyes 18 are used as guide means 11, one or more of which are connected with one end on a needle bar. This needle bar together with a prism-shaped linear guide extending in the weft direction 12 forms the sliding displacement device 5, which is secured on the front side of a heald frame together with an electric motor drive as the sliding displacement drive 6. A linear drive, of which the stator is integrated into the frame of the heald frame or into the prism-shaped linear guide, is provided as the sliding displacement drive 6. However, other drives are also conceivable, for example drives with motion spindles or hydraulic or pneumatic drives, which can be controlled from a control device 8 of the weaving machine.

In the scope of the invention, of course an embodiment is also possible in which the weaving machine comprises several sliding displacement devices 5 with respectively their own sliding displacement drive 6. Therewith different guide means 11 or different groups of guide means 11 can be slidingly displaced in the weft direction 12 independently of one another for each motion cycle.

In each motion cycle of the weaving machine, sliding displacements A of the effect threads 2 can be prescribed by the sliding displacement drive 6, which drives the sliding displacement device 5. The respective sliding displacement A is derivable from an inventive data set 20 by a control device 8 and the sliding displacement drive 6 for each motion cycle of the weaving machine. A computer program that is being executed in the control device 8 calculates the sliding displacements A from the inventively produced data sets 20. Thereby, the associated motion cycle of the pattern repeat 29 is derived from the stored data values of the weft sequence number 30, while the sliding displacement A is calculated from the stored data values of the additional weft effects DS. In that regard, if applicable, any present data values as to the raster division TS underlying an effect raster area 24 and/or data values as to a reference line A01 in the woven fabric 26 are taken into consideration.

Depending on the embodiment of the inventive method being used for producing the data sets 20, e.g. the following calculations can be carried out for determining two successive sliding displacements A1 or A2:

$$A1=DS1$$

$$A1=TX\times DS1$$

$$A2=A1+(TS\times DS2)$$

$$A1=A01+(TS\times DS1).$$

Thereby, DS1 or DS2 are the data values of the additional weft effects DS stored in two successive data sets 20. Naturally it can also arise, that no sliding displacement A is to be carried out in the respective motion cycle. Of course, within the scope of this calculation in the control device 8 it is possible to convert the data values from the data sets 20 or the calculated sliding displacements into data formats or values that are respectively suitable for the further electronic processing or for the control of the sliding displacement drive 6.

In order to be able to position the effect threads 2 also vertically over or under the weft thread 3 to be inserted, in the present example embodiment, guide means 11, sliding displacement device 5 and sliding displacement drive 6 are connected with one of the shedding means 4 and are vertically moved together therewith. In this case, the shedding means 4 is drivable by one of the above described shedding drives 9 of a shedding machine 23. The vertical stroke of this shedding means 4 must be adjusted larger than the vertical stroke of the shedding means 4 that carry out the ground weave, because only the effect threads 2, but not the warp threads 1 shall emerge upwardly out of the reed gaps 14.

From the FIGS. 5 and 6 it can further be seen that the guide means 11 is movable in a plane that extends between the shedding means 4 and that one of two end positions of a beat-up motion 15-15.1 of the reed blades 7, which is located closer to the shedding means 4; this is the position of the reed blades 7 during the weft insertion.

Through this arrangement it arises that the effect threads 2 can dive or submerge into or emerge out of the reed gaps 14, and can take up a different position in the weft direction 12, which position is prescribable within a broad range, for each motion cycle of the weaving machine.

In the present example embodiment, the effect threads 2 are delivered from a thread supply 16 on the back side of the weaving machine over a thread deflector 17 to the thread eyes 18 of the guide means 11.

In an embodiment of the inventive weaving machine with several guide means 11, sliding displacement devices 5 and mutually independent sliding displacement drives 6, it is suitable or sensible to arrange each one of these systems of guide means 11, sliding displacement device 5 and sliding displacement drive 6 on its own shedding means 4. Details of such an embodiment can be taken from the already cited DE 10 2010 007 048.3-26.

Because the sliding displacement of the effect thread 2 must take place after the emergence out of the reed gap 14, before the motion of the shedding means 4 for the next submersion into a reed gap 14 begins, it is necessary to carry out this sliding displacement in a motion cycle that precedes the one in which an interlacing point P is formed. In the weaving pattern formation s based on the pattern draft 28 of the FIG. 3.1, the sliding displacement of the effect threads 2 in the weaving machine respectively takes place in a motion cycle in which a weft is inserted but no interlacing point P is formed.

In the motion cycles that include an interlacing point P, no sliding displacement of the effect threads 2 takes place.

The data values of the additional weft effects DS must already be read and converted into a sliding displacement A already in a motion cycle before the formation of an interlacing point P. In order that sufficient time is available for this process even in fast-running weaving machines, in all of the pattern drafts illustrated here the data values of the additional weft effects DS for the sliding displacement A for the next interlacing point P are already stored in data sets 20 of preceding motion cycles occurring therebefore, even if no interlacing point P is formed therein.

All examples of pattern drafts 28 shown here are intended for carrying out on weaving machines with electronic shedding machines 23 of the above described type. In all of these cases, the ground weave and the vertical motion of the effect threads 2 are produced by shedding means 4 from the same shedding machine 23.

It can be desired that several effect threads 2 are synchronously slidingly displaced and positioned, in order to produce a weaving pattern with parallel-running additional weft effects. The pattern draft 28 with data sets 20 necessary therefore, which is produced with a method according to the present invention, can look exactly like one for a single effect thread 2, because only one common sliding displacement device 5 and only one common shedding means 4 are needed for the formation of the additional weft effect.

Figure 7:
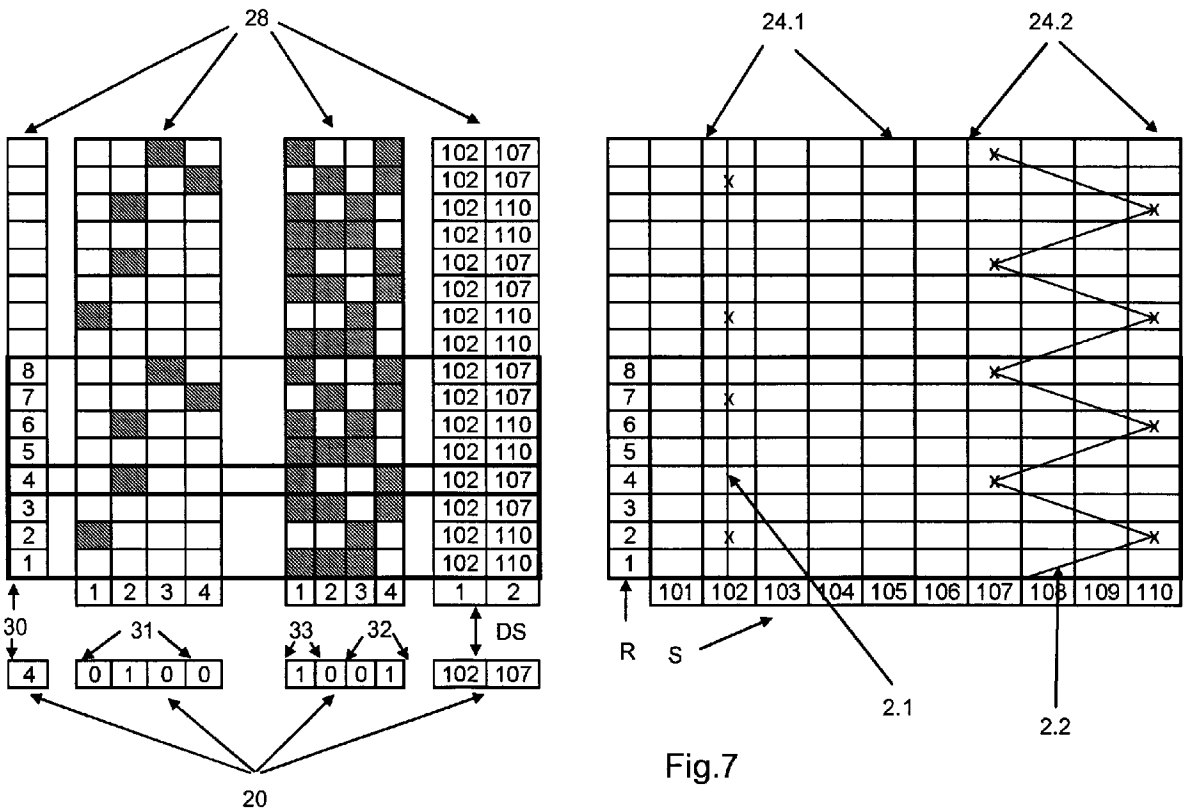

For certain weaving patterns it can be desired that the effect thread 2 remains positioned above the weft thread to be inserted and no sliding displacement takes place during several motion cycles. A so-called floating of the effect thread 2 in the warp direction is formed on the front side of the woven fabric 26. An example for a pattern draft 28 with inventive data sets 20 for such a woven fabric 26 can be seen in the FIG. 7. Thereby, no interlacing between the effect thread 2 and several inserted weft threads 3 takes place. In the finished woven fabric 26, the effect thread 2 lies over several weft threads 3.

Figure 8:
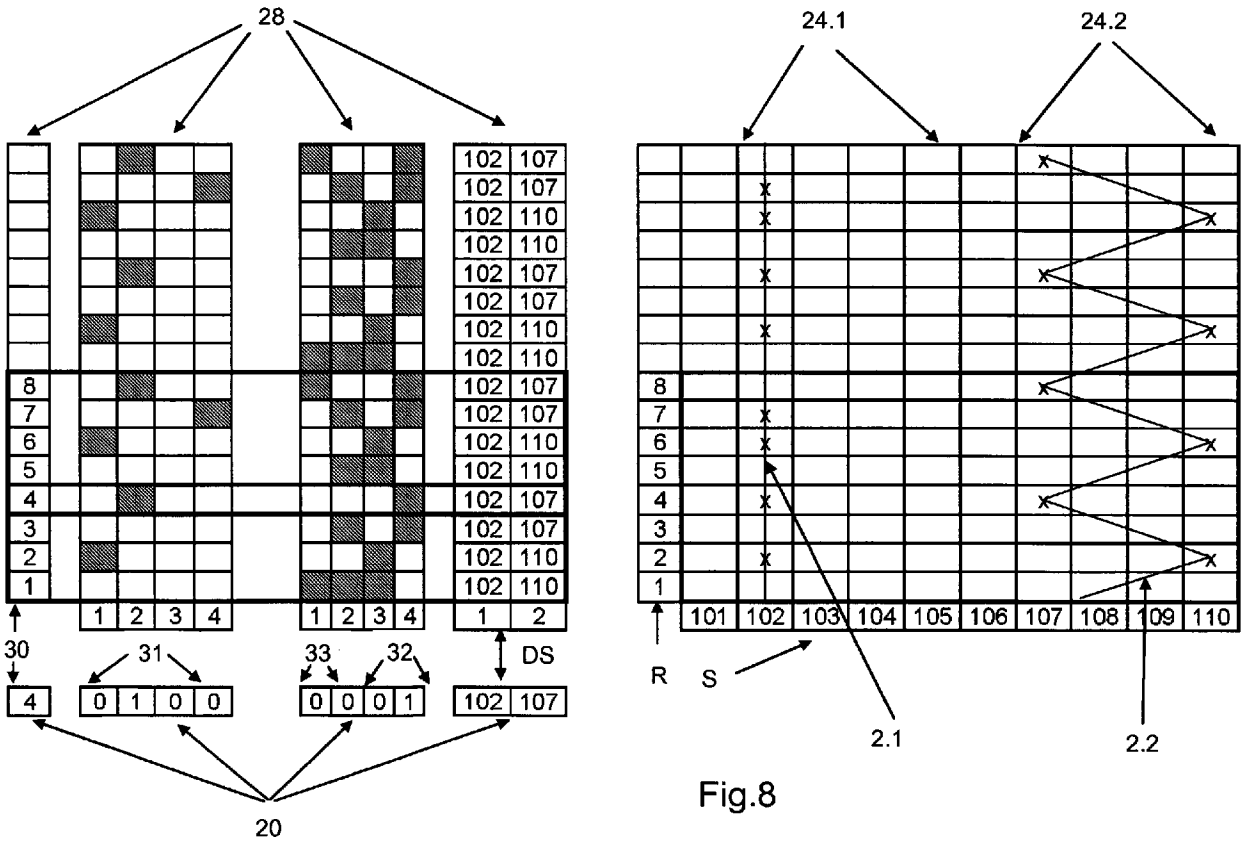

The FIG. 8 shows a pattern draft 28 with data sets 20 in which such a floating is formed on the back side of the woven fabric 26.

The FIG. 9 finally shows a pattern draft 28 for a woven fabric with an obliquely angled floating in warp and in weft direction extending over several weft and warp threads.

REFERENCE CHARACTERS

1 warp thread
1.1 loom shed, upper shed
1.2 loom shed, lower shed
2, 2.1, 2.2 effect thread
3 weft thread
4 shedding means
5 sliding displacement device
6 sliding displacement drive
7 reed blade or dent
7.1 reed band
8 control device
9 shedding drive
10 reed support
11 guide means
12 weft direction
13 fabric edge
14 reed gaps
15-15.1 beat-up motion
16 thread supply
17 deflection device
18 thread eye
19 selection device for weft thread type
20 data set
21 input means
22 memory means
23 shedding machine
24.1, 24.2 effect raster area
25 raster field
26 woven fabric or web
28 pattern draft
29 pattern repeat
30 data values of the weft sequence number
31 data values of the selection weft thread type
32 data values of the base or ground weave
33 data values of the effect weave
34 data values of the additional functions
35.1, 35.2 reference lines
A sliding displacement
A01 position reference line
DS data of the additional weft effects
K crossing point in the woven fabric
P interlacing point in the woven fabric
R characteristic indicium of raster row
S characteristic indicium of raster column
TR reed division
TS raster division in weft direction
X position of interlacing point in effect raster area

The invention claimed is:

1. A method of controlling a weaving machine for producing a woven fabric of warp threads, weft threads and at least one effect thread, wherein each said effect thread forms interlacing points at which said effect thread crosses behind respective ones of said weft threads on a back side of said woven fabric and crossing points at which said effect thread crosses over in front of respective ones of said weft threads on a front side of said woven fabric, wherein respective ones of said interlacing points are spaced apart from one another with a respective plurality of said warp threads therebetween in a weft direction of said woven fabric, and wherein said method comprises steps:

a) specifying a pattern repeat area for said woven fabric, wherein said pattern repeat area extends in said weft direction and in a warp direction of said woven fabric and represents a pattern repeat of a weave pattern of said woven fabric, wherein said weave pattern comprises successive weave pattern rows successively after one another in said warp direction, and wherein said weave pattern rows include interlacing weave pattern rows that respectively include at least a respective one of said interlacing points in said pattern repeat;

b) producing plural data sets including a respective interlacing data set for each respective one of said interlacing weave pattern rows, wherein each said interlacing data set includes plural data values comprising a first data value derived from a weft sequence number of a respective one of said weft threads behind which said effect thread crosses at said respective interlacing point, a second data value derived from a position of said respective interlacing point in said weft direction in said pattern repeat, and at least one further data value derived from said weave pattern;

c) forming, with said plural data sets, a pattern draft for said weave pattern;

d) storing said pattern draft in a data storage medium; and e) using a control device of said weaving machine, reading out said data values of said data sets of said pattern draft from said data storage medium, and in accordance with said data values controlling a weaving operation of said weaving machine to produce said woven fabric.

2. The method according to claim 1, wherein said weave pattern rows further include non-interlacing weave pattern rows that do not include one of said interlacing points, wherein said plural data sets further include a respective non-interlacing data set respectively for each said non-interlacing weave pattern row, and wherein said respective non-interlacing data set includes a first non-interlacing row data value derived from a weft sequence number of said respective non-interlacing weave pattern row and a second non-interlacing row data value derived from said second data value of said respective interlacing data set of said interlacing weave pattern row that follows successively in said warp direction after said respective non-interlacing weave pattern row.

3. The method according to claim 1, wherein each one of said weave pattern rows corresponds to one weaving motion cycle of said weaving machine, which may include a weft insertion and a reed beat-up of one of said weft threads or may be a weftless motion cycle in which no weft thread is inserted.

4. The method according to claim 1, wherein said weave pattern rows further include non-interlacing weave pattern rows that do not include one of said interlacing points, wherein said plural data sets further include a respective non-interlacing data set respectively for each said non-interlacing weave pattern row, wherein each said non-interlacing data set includes plural data values comprising a first data value derived from a weft sequence number of said respective non-interlacing weave pattern row and at least one further data value derived from said weave pattern, further comprising determining locations of said crossing points at which said effect thread is on said front side of said woven fabric and of said interlacing points at which said effect thread is on said back side of said fabric, and wherein said at least one further data value in each said data set comprises an effect thread position data value which indicates whether said effect thread is on said front side or said back side of said fabric in said respective weave pattern row to which said respective data set pertains.

5. The method according to claim 1, further comprising defining a reference line extending in said warp direction along said fabric, and wherein said second data value in each respective said interlacing data set is equal to a respective geometric spacing distance from said reference line, in said weft direction, of said respective interlacing point in said respective interlacing weave pattern row.

6. The method according to claim 1, further comprising defining a reference line extending in said warp direction along said fabric, and wherein said second data value in each respective said interlacing data set is calculated from a difference between two geometric spacing distances from said reference line, in said weft direction, respectively of two successive ones of said interlacing points in two successive ones of said interlacing weave pattern rows.

7. The method according to claim 1, further comprising drawing said warp threads into reed gaps of a reed of a weaving reed device of said weaving machine, wherein said reed gaps are spaced from one another according to a defined reed division, a respective reference indicium is assigned respectively to each one of said reed gaps, said first data value in each respective said interlacing data set is respectively equal to said weft sequence number, and said second data value in each respective said interlacing data set is respectively derived from said respective reference indicium of a respective one of said reed gaps associated with said respective interlacing point.

8. The method according to claim 7, wherein said reference indicia of said reed gaps comprise respective numbers in an increasing or decreasing number sequence.

9. The method according to claim 8, wherein said second data value in each respective said interlacing data set is calculated from a difference between two of said respective numbers assigned respectively to two of said reed gaps.

10. The method according to claim 1, wherein said at least one effect thread of said woven fabric comprises plural effect threads within said pattern repeat area, said plural effect threads respectively form a plurality of said interlacing points with a respective one of said weft threads in a respective one of said interlacing weave pattern rows, and said data values of each said respective interlacing data set include a plurality of said second data values respectively derived from respective different positions of said plural interlacing points in said respective interlacing weave pattern row.

11. The method according to claim 1, further comprising defining additional data values that relate to parameters of said woven fabric and associated adjustments of said weaving machine, and combining said additional data values with one or more said pattern draft to form an article data set.

12. The method according to claim 1, wherein said data storage medium comprises an exchangeable memory device in which said pattern draft is stored in a specified data format.

13. The method according to claim 1, further comprising graphically or tabularly displaying said data sets on a computer display screen of said weaving machine using a computer program being executed in said control device of said weaving machine.

14. The method according to claim 13, further comprising producing said data sets using said computer program, by interactive input of graphic symbols or alphanumeric characters in graphically represented raster fields of an effect raster area and in graphically represented data fields or raster fields of said pattern draft on said computer display screen.

15. A non-transitory tangible machine-readable data storage medium encoded with and storing a functional data structure comprising a pattern draft, which when read by a control device of a weaving machine controls a weaving operation of said weaving machine to produce a woven fabric, in accordance with said pattern draft, of warp threads, weft threads and at least one effect thread, wherein each said effect thread forms interlacing points at which said effect thread crosses behind respective ones of said weft threads on a back side of said woven fabric and crossing points at which said effect thread crosses over in front of respective ones of said weft threads on a front side of said woven fabric, wherein respective ones of said interlacing points are spaced apart from one another with a respective plurality of said warp threads therebetween in a weft direction of said woven fabric, wherein:

said pattern draft comprises plural data sets respectively allocated to successive weave pattern rows of a weave pattern in a pattern repeat area for said woven fabric, said pattern repeat area extends in said weft direction and in a warp direction of said woven fabric and represents a pattern repeat of said weave pattern, said successive weave pattern rows follow successively after one another in said warp direction, said weave pattern rows include interlacing weave pattern rows that respectively include at least a respective one of said interlacing points in said pattern repeat, and said plural data sets include a respective interlacing data set for each respective one of said interlacing weave pattern rows, wherein each said interlacing data set includes plural data values comprising a first data value derived from a weft sequence number of a respective one of said weft threads behind which said effect thread crosses at said respective interlacing point, a second data value derived from a position of said respective interlacing point in said weft direction in said pattern repeat, and at least one further data value derived from said weave pattern.

16. A weaving system comprising said data storage medium according to claim 15 in combination and connected with a weaving machine, wherein said weaving machine comprises:

an effect thread guide device that is configured and arranged to guide said effect thread, a sliding displacement device that is configured and arranged and connected to said guide device so that said guide device and therewith said effect thread are slidably displaceable in said weft direction, a sliding displacement drive connected with said sliding displacement device so as to drive a sliding displacement thereof, a vertical motion mechanism connected to said guide means and configured to vertically move said guide means by a vertical motion, a weaving reed device configured and arranged to beat-up said weft thread against a woven fabric edge of said woven fabric by carrying out a back-and-forth beat-up motion, wherein said weaving reed device comprises a row of reed blades with reed gaps respectively therebetween, wherein said reed gaps are upwardly open, and wherein said weaving reed device and said guide device are configured and arranged so that said effect thread can be submerged downwardly into and emerged upwardly out of said reed gaps, a user input device;

a control device that is configured to execute a computer program and that is connected for signal transmission with said user input device, said data storage medium, said sliding displacement drive and said vertical motion mechanism, so that said control device executing said computer program reads out said pattern draft from said data storage medium and accordingly controls successive motion cycles of said weaving machine respectively according to successive ones of said data sets of said pattern draft, wherein at least said sliding displacement of said sliding displacement device and said guide device and said effect thread is controlled according to said second data values of said interlacing data sets of said pattern draft by said control device executing said computer program.

17. The weaving system according to claim 16, wherein:

said vertical motion mechanism of said weaving machine comprises a shedding device configured and arranged to form sheds of said warp threads, and a shedding machine that is connected to said shedding device so as to drive a shedding motion of said shedding device, said control device is connected for signal transmission with said vertical motion mechanism in that said control device is connected for signal transmission with said shedding machine, and said vertical motion mechanism is connected to said guide device in that said shedding device is connected with said sliding displacement drive and with said sliding displacement device which is connected to said guide device, such that said guide device can be moved by said shedding device under control by said control device according to said at least one further data value in a respective said data set of said pattern draft, to move said effect thread above or below a weft thread that is to be inserted.

18. A non-transitory tangible machine-readable data storage medium storing a data structure comprising a pattern draft, which when read by a control device of a weaving machine controls a weaving operation of said weaving machine to produce, in accordance with said pattern draft, a woven fabric of warp threads running in a warp direction, weft threads running in a weft direction, and at least one effect thread that crosses over a respective one of said weft threads at a crossing point and crosses under a respective one of said weft threads at an interlacing point according to a weave pattern, wherein:

said weave pattern comprises successive pattern rows that extend in said weft direction and successively follow one another in said warp direction, said pattern draft comprises successive data sets that are respectively individually allocated to said pattern rows, and a respective one of said data sets allocated to a respective one of said pattern rows having at least one of said interlacing points includes a first data value identifying said respective pattern row, and a second data value identifying a position, in said weft direction, of said interlacing point in said respective pattern row.

* * * * *

UNITED STATES PATENT AND TRADEMARK OFFICE

CERTIFICATE OF CORRECTION

PATENT NO. : 8,733,406 B2
APPLICATION NO. : 13/809271
DATED : May 27, 2014
INVENTOR(S) : Christian Hannes et al.

It is certified that error appears in the above-identified patent and that said Letters Patent is hereby corrected as shown below:

In the Specification

Column 11,
Line 14, after "draft", insert --28--;

Column 13,
Line 9, after "used", "therefore" should read --therefor--;

Column 16,
Line 8, "A1=TX×DS1" should read --A1=TS×DS1--;
Line 64, after "formation", delete "s";

Column 17,
Line 8, after "drafts", insert --28--;
Lines 22/23, "therefore" should read --therefor--;
Line 43, after "fabric", insert --26--.

Signed and Sealed this
Thirteenth Day of January, 2015

Michelle K. Lee

Michelle K. Lee
*Deputy Director of the United States Patent and Trademark Office*